US009526272B2

(12) United States Patent
Liu

(10) Patent No.: US 9,526,272 B2
(45) Date of Patent: Dec. 27, 2016

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 871 days.

(21) Appl. No.: 13/900,220

(22) Filed: May 22, 2013

(65) Prior Publication Data

US 2014/0283858 A1 Sep. 25, 2014

Related U.S. Application Data

(63) Continuation of application No. PCT/CN2013/073070, filed on Mar. 22, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008; A24F 47/00
See application file for complete search history.

(56) References Cited

U.S. PATENT DOCUMENTS 9,078,473 B2 * 7/2015 Worm ..... A24F 47/008
2008/0092912 A1 4/2008 Robinson et al.
2011/0303231 A1 * 12/2011 Li ..... A24F 47/008 131/329
2012/0111347 A1 * 5/2012 Hon ..... A24F 47/008 131/329
2012/0234315 A1 * 9/2012 Li ..... A24F 47/008 128/200.21
2013/0192623 A1 * 8/2013 Tucker ..... H01C 17/00 131/329

(Continued)

FOREIGN PATENT DOCUMENTS

CN 201379072 Y 1/2010
CN 102266125 A 12/2011

(Continued)

OTHER PUBLICATIONS

International Search Report for Application No. PCT/CN2013/073070 dated Jan. 2, 2014.

*Primary Examiner* — Jerzi H Moreno Hernandez
(74) *Attorney, Agent, or Firm* — Tim Tingkang Xia, Esq.; Locke Lord LLP

(57) ABSTRACT

The present invention discloses an electronic cigarette. The electronic cigarette includes a battery container, an outer sleeve connected to the battery container, a battery assembly received in the battery container, an atomizer seat defining a second through hole, a glass fiber tube defining a channel and an atomizer electrode defining a first through hole. ALL of the atomizer seat, the glass fiber tube and the atomizer electrode is received in the outer sleeve. The battery container defines at least one air inlet. A first gap is formed between the atomizer electrode and the battery assembly in an axial direction. The air inlet is communicated with the first gap. The air inlet, the first through hole, the second through hole and the channel form an air flow loop. When a user hands the electronic cigarette, his/her fingers would not plug up the air inlet.

3 Claims, 5 Drawing Sheets

(56) References Cited

U.S. PATENT DOCUMENTS

| | | | | |
|---|---|---|---|---|
| 2013/0298905 | A1* | 11/2013 | Levin | A24F 47/008 128/202.21 |
| 2014/0182612 | A1* | 7/2014 | Chen | A24F 47/008 131/329 |
| 2015/0257449 | A1* | 9/2015 | Gabbay | A24F 47/008 392/386 |

FOREIGN PATENT DOCUMENTS

| | | | |
|---|---|---|---|
| CN | 202127820 | U | 2/2012 |
| WO | 2008130813 | A1 | 10/2008 |

* cited by examiner

ELECTRONIC CIGARETTE

CROSS-REFERENCE TO RELATED APPLICATIONS

This application is a continuation of International Patent Application No. PCT/CN2013/073070, with an international filing date of Mar. 22, 2013, designating the United States, now pending. The contents of these specifications are incorporated herein by reference.

FIELD OF THE INVENTION

The present invention relates to the technical field of electronic-heating technology, and more particularly relates to an electronic cigarette.

BACKGROUND OF THE UTILITY MODEL

Because domestic publicity of anti-smoking and the people's awareness of health are enhanced, electronic cigarettes, which serve as the substitute of traditional tobacco, have been more and more widely used. An existing electronic cigarette comprises a cigarette rod and a cigarette holder fixed together. A battery is received in the cigarette rod, and an atomizer is received in the cigarette holder. A connector is connected between the cigarette stem and the cigarette holder, and the cigarette rod is connected with the cigarette holder by a connection component. In a structure of the existing electronic cigarette, an air inlet is defined in the connection component. However, the connector is closed to the cigarette holder. When users use the electronic cigarette, the handheld position for using the electronic cigarette is closed to the connector. In such case, fingers of the users may often plug up the air inlet, which may cause poor intake into the air let, and may further adversely affect the effect of generating smoke.

SUMMARY OF THE INVENTION

Aiming at the drawbacks in the prior art that the air inlet is closed to the connector and easily to be plugged up, an electronic cigarette is provided. Wherein such electronic cigarette is provided with an air inlet that is placed in a battery container. Such construction that the air inlet is set in the battery container can avoid the fingers plugging up the air inlet, further make the air flow smoothly and generate smoke quickly, and further can meet users' individuation needs.

According to an aspect, a proposed electronic cigarette includes a battery container, an outer sleeve connected with the battery container, a battery assembly received in the battery container, an atomizer seat, a glass fiber tube and an atomizer electrode; all of outer sleeve the atomizer seat, glass fiber tube and the atomizer electrode atomizer electrode received in the outer sleeve;

wherein the atomizer electrode defines a first through hole, the atomizer seat defines a second through hole, and the glass fiber tube defines a channel;

wherein the battery container is provided with at least one air inlet, and a first gap is formed between the atomizer electrode and the battery assembly along an axial direction;

wherein the air inlet is communicated with the first gap, and the air inlet, the first gap, the first through hole, the second through hole and the channel form an air flow loop.

The air inlet is located in a part of the battery container corresponding to the first gap.

A second gap is formed between the battery container and the battery assembly.

The air inlet is located in a part of the battery container corresponding to the second gap.

The first through hole, the second through hole and the channel are all coaxial.

The battery container defines at least two air inlets, and the air inlets are separated from to each other.

The air inlets are located in a same radial direction of the battery container equidistantly.

The air inlets are located in an axial direction of the battery container equidistantly.

An area of the air inlet is ranged from 0.4 to 3 $mm^2$.

A shape of the air inlet is any one of round, polygon, waist form and oval.

A width of the first gap is ranged from 0.5 to 10 mm.

A width of the second gap is ranged from 0.05 to 7 mm.

The electronic cigarette further includes a seal ring, wherein the seal ring is mounted at a side of the atomizer electrode away from the atomizer seat, and is configured to seal the battery container.

The seal ring defines an opening, wherein the opening of the seal ring is communicated with the first through hole.

The electronic cigarette further includes a supporting member of a hollow cylindrical shape;

wherein the supporting member includes a fixing portion and a sleeve portion being perpendicular to the fixing portion;

wherein the fixing portion is configured to connect the atomizer seat with the atomizer electrode, and the sleeve portion is received in the second through hole.

The battery container is integral to the outer sleeve.

When implanting the invention, the following advantages can be achieved: in this invention, the air inlet is defined in the battery container, and when a user is using the electronic cigarette, the battery container would become hot, and the user is forced to avoid putting his/her fingers of users on the battery container. In this way, the air can enter the air inlet smoothly and smoke can be brought out easily, which meets users' individuation needs.

BRIEF DESCRIPTION OF THE DRAWINGS

The present invention can be further illustrated by reading the example with references made to the accompanying drawings, in which.

DETAILED DESCRIPTION OF THE PREFERRED EMBODIMENT

For recognizing the technique character, the object and the effect more clearly, the special implement of the invention is illustrated in detail with references to the accompanying drawings.

Figure 1:
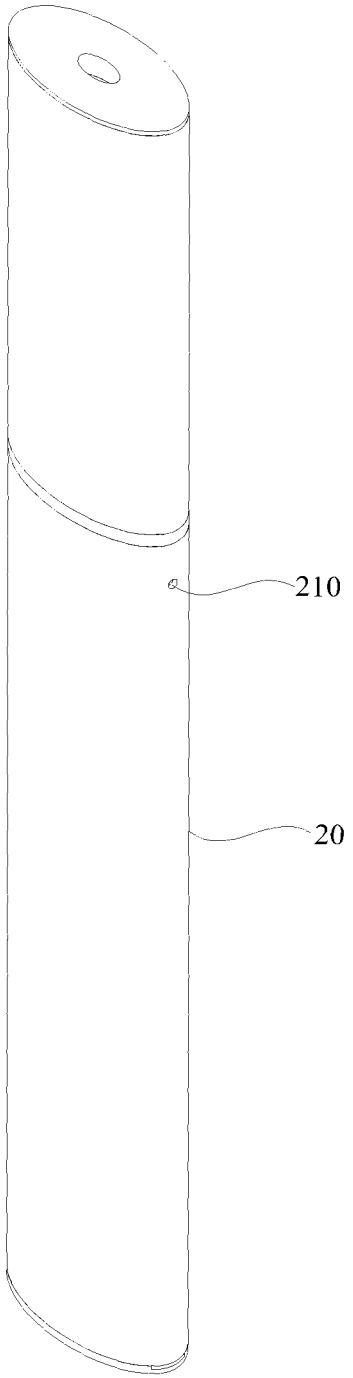
FIG. 1 is a schematic view of a whole structure of an electronic cigarette in accordance with an embodiment of the present invention.
Figure 2:
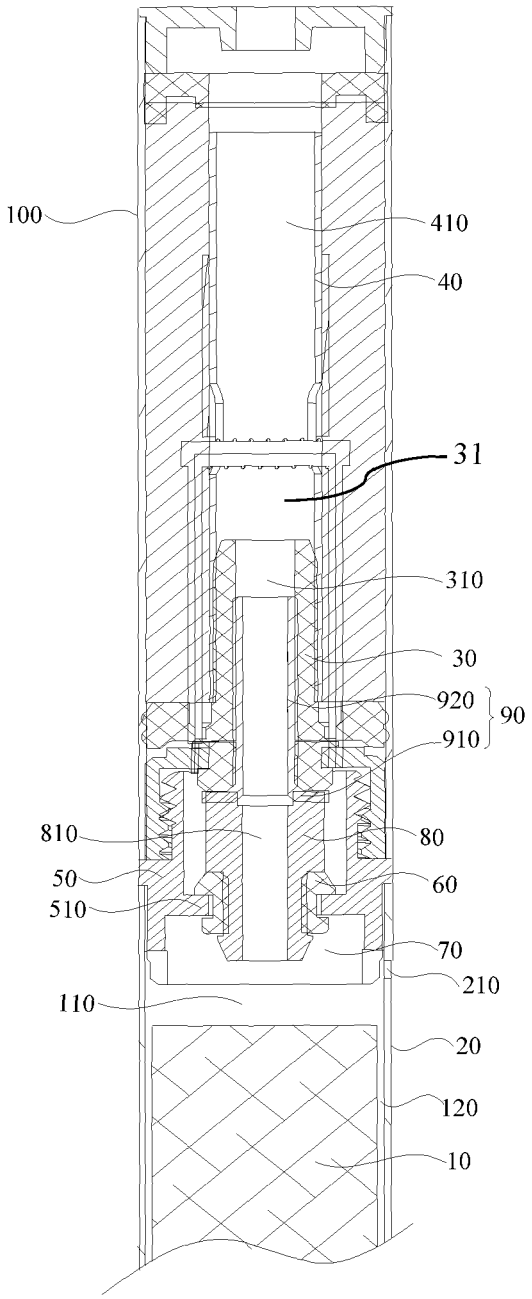
FIG. 2 is a partial cutaway view of an electronic cigarette in accordance with an embodiment of the present invention.

As shown in FIG. 1 and FIG. 2, an electronic cigarette is provided by the preferred embodiment of the invention. The electronic cigarette includes a battery container 20, an outer sleeve 100, a battery assembly 10, an atomizer seat 30, a glass fiber tube 40, a threaded sleeve 50, an insulating ring 60, a seal ring 70, an atomizer electrode 80, and a supporting member 90. The outer sleeve 100 is connected with the battery container 20. The battery assembly 10 is received in the battery container 20. The atomizer seat 30, the glass fiber tube 40, the threaded sleeve 50, the insulating ring 60, the seal ring 70, the atomizer electrode 80, and the supporting member 90 are all received in the outer sleeve 100. In this embodiment, the battery container 20 is integral with the outer sleeve 100, which facilitates producing of the electronic cigarette, and achieving a good whole effect.

The glass fiber tube 40 is cylindrical and defines a through hole (not labeled). A heating assembly 31 passes through the through hole of the glass fiber tube 40 traverse, and is fixed inside the glass fiber tube 40 to form a channel 410 configured to make smoke circulate in the electronic cigarette.

The atomizer seat 30 is connected with the atomizer electrode 80. Wherein such atomizer seat 30 includes a main body of the atomizer seat (not labeled) and a cylinder being perpendicular to the main body of the atomizer seat (not shown labeled). The cylinder is substantially a hollow cylinder, and an end of the cylinder that is away from the atomizer electrode 80 engages in the glass fiber tube 40. The hollow cylinder of the atomizer seat 30 forms a second through hole 310 configured to make the air flow.

An end of the atomizer seat 30 that is away from the glass fiber tube 40 is connected to the atomizer electrode 80. The atomizer electrode 80 defines a first through hole 810. The first through hole 810, the second through hole 310 and the channel 410 communicate with each other, and are all coaxial.

The supporting member 90 is a hollow cylinder, which is similar to the atomizer seat 30. The supporting member 90 includes a fixing portion 910 and a sleeve portion 920 being perpendicular to the fixing portion 910. Wherein the fixing portion 910 is configured to connect the atomizer seat 30 with the atomizer electrode 80. The hollow sleeve portion 920 is sleeved in the second through hole 310 and configured to support the atomizer seat 30.

The threaded sleeve 50 is configured to make the atomizer electrode 80 be fixed. The threaded sleeve 50 is provided with an extension 510 extending toward the atomizer electrode 80. The extension 510 engages in the insulating ring 60, and is connected with the atomizer electrode 80. The threaded sleeve 50 is connected with the atomizer electrode 80 by the insulating ring 60, thereby insulating heat and sealing the electronic cigarette.

In this embodiment, for achieving better sealing effect of the atomizer electrode 80, the threaded sleeve 50, and the battery container 20 and preventing oil leak, the sealing ring 70 is mounted at the end of the atomizer electrode 80 that is away from the atomizer seat 30 to seal the battery container 20. The sealing ring 70 is made of any one of nitrile butadiene rubber, natural rubber, chloroprene rubber, ethylene propylene rubber, fluoro rubber, silicone rubber, and alloying rubber. The sealing ring 70 is provided with an opening. The opening of the seal ring 70 communicates with the first through hole 810 to make the air flow.

The battery container 20 defines at least one air inlet 210. A first gap 110 is formed between the atomizer electrode 80 and the battery assembly 10 along an axial direction. The air inlet 210, the first gap 110, the first through hole 810, the second through hole 310 and the channel 410 cooperatively form an air flow loop. In the special implement, the first gap 110 is formed between the sealing ring 70 and the battery assembly 10 in the axial direction. The width of the first gap 110 is ranged from 0.5 to 10 mm to make the air enter from the air inlet 210 and flow upward.

The air inlet 210 can be located in any position of the battery container 20. In specially, when the air inlet 210 is located in a part of the battery container 20 corresponding to the first gap 110, air can enter from the air inlet 210, and then flow upward via the air flow loop formed by the first gap 110, the first through hole 810, the second through hole 310 and the channel 410. Because the battery assembly 10 is sleeved in the battery container 20 and only a tiny gap is left between the battery assembly 10 and the battery container 20 to make the air flow, the air inlet 210 can also be located in a part of the battery container 20 corresponding to the battery assembly 10. Wherein in such case, air can enter the air inlet 210 and flow through the tiny gap between the battery assembly 10 and the battery container 20, and then flow upward via the air flow loop formed by the first gap 110, the first through hole 810, the second through hole 310 and the channel 410 orderly. However, because a width of the gap between the battery assembly 10 and the battery container 20 may be too small, a second gap 210 may be formed between the battery assembly 10 and the battery container 20. The second gap 210 is configured to make the air flow be more smoothly. In special, a width of the second gap is ranged from 0.05 to 7 mm to make the air flow be more smoothly.

The air inlet 210 may be placed in any position of the battery container 20. Since the battery assembly 10 is received inside the battery container 20, the battery container 20 will become hot while users is using the electronic cigarette. In such case, when users hand the electronic cigarette, they will not put their fingers on the battery container 20, which prevents the fingers from plugging up the air inlet 2 and makes air enter the air inlets smoothly. Thus, smoke can be brought out easily, and users' individuation needs are met. In the embodiment, the number of the air inlet 210 is one. The air inlet 210 is positioned adjacent to the sealing ring 70. In such case, air enters the air inlet 210, and then flows upward via the air flow loop formed by the first gap 110, the first through hole 810, the second through hole 310 and the channel 410 in order. It is can be understood that the air inlet 210 may also be placed in a part of the battery container 20 corresponding to the second gap 120, or other positions, so long as the air inlet 210 is placed in the battery container 20.

If the battery container 20 defines at least two air inlets 210, the air inlets 210 should be separated from each other. In special, they may be located equidistantly or not. The air inlets 210 may be located in a same radial direction of the battery container 20 equidistantly to form a circle ring on the battery container 20, thereby making the electronic cigarette look beautiful and generous. The air inlets 210 may also be located in an axial direction of the battery container 20 equidistantly, that is, the air inlets 210 are located on a same straight line. Otherwise, some of the air inlets 210 can be located in a part of the battery container 20 corresponding to the first gap 110, and the others of the air inlets 210 are located in a part of the battery container 20 corresponding to the second gap 120.

The shape of the air inlet 210 may be any one of round, polygon, waist form and oval, or may be other irregular shapes.

If there are a plurality of air inlets 210, the total area of openings of the air inlets 210 formed on the outer sidewall of the battery container 20 is ranged from 0.3 to 4 $mm^2$. If the total area is less than 0.4 $mm^2$, the amount of the air flow is too small, which causes the amount of the smoke to be too small, and may adversely affect the taste of smoking. If the total area is more than 3 $mm^2$, the amount of the air flow is too large, which may cause the smoke to enter mouths of users directly, and may make the users feel bad.

Figure 3:
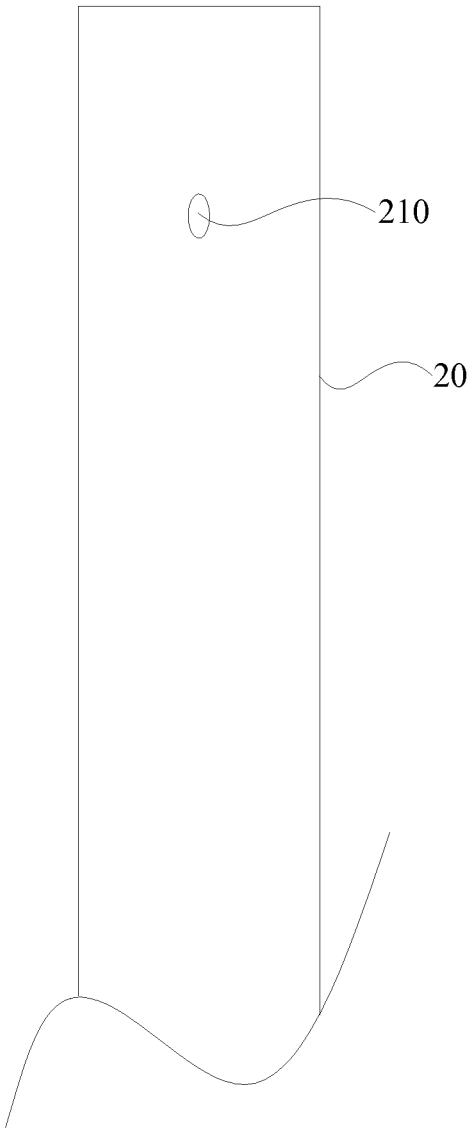
FIG. 3 is a schematic view of a part of a structure of a battery container in accordance with a first embodiment of the present invention.

Referring to FIG. 3, in the first embodiment of the invention, the shape of the air inlet 210 is round. There is only one air inlet 210 located in any position of the battery container 20.

Figure 4:
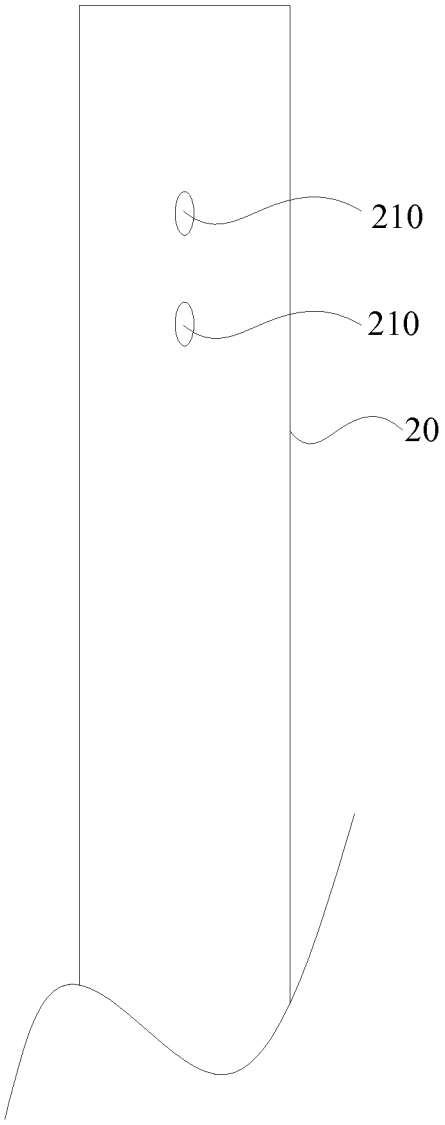
FIG. 4 is a schematic view of a part of a structure of a battery sleeve in accordance with a second embodiment of the present invention.

Referring to FIG. 4, in the second embodiment of the invention, the shape of the air inlet 210 is round. There are two air inlets 210 located in an axial direction of the battery container 20 equidistantly.

Figure 5:
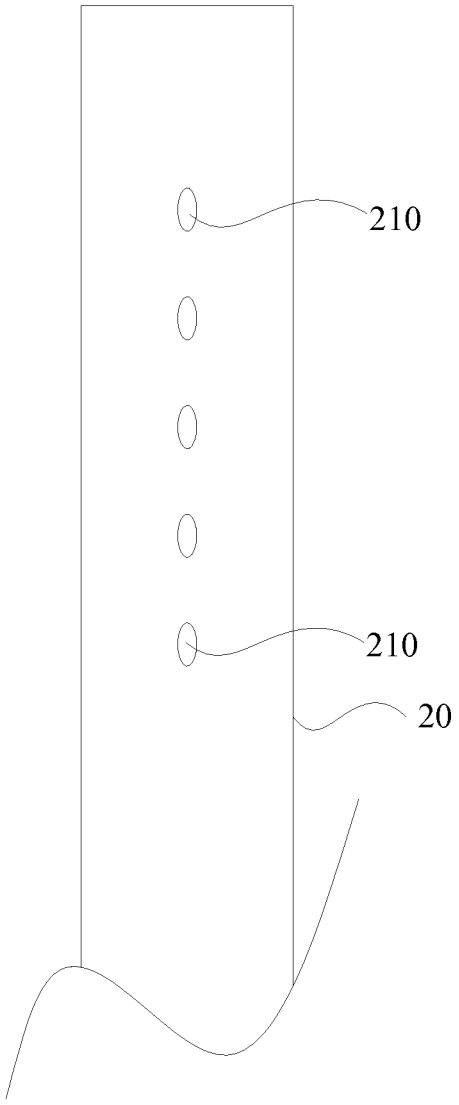
FIG. 5 is a schematic view of a part of a structure of a battery sleeve in accordance with a the third embodiment of the present invention.

Referring to FIG. 5, in the third embodiment of the invention, the shape of the air inlet 210 is round. There are five air inlets 210 located in the axial direction of the battery container 20 equidistantly.

The three embodiments said above are schematic. The relationship between the number, the shape and the position of the air inlets 210 may be changed in other embodiment, and is not limited by these embodiments.

In this invention, the air inlet(s) 210 is/are defined in the battery container 20. When users are using the electronic cigarette, the battery container will become hot and prevents the users from putting their fingers on the battery container 20 and plugging up the air inlet(s) 210. In this way, air can enter the air inlet(s) 210 smoothly and smoke can be brought out easily, which meets users' individuation needs.

While the present invention has been described by reference to preferred embodiments, it will be understood by those skilled in the art that various changes may be made and equivalents may be substituted without departing from the scope of the present invention. However, all the changes will be included within the scope of the appended claims.

The invention claimed is:

1. An electronic cigarette comprising a battery container, an outer sleeve connected with the battery container, a battery assembly received in the battery container, an atomizer seat, a glass fiber tube, an atomizer electrode and a heating assembly; the atomizer seat, the glass fiber tube and the atomizer electrode are all received in the outer sleeve; the atomizer electrode defining a first through hole, the atomizer seat defining a second through hole, and the glass fiber tube defining a channel;

wherein the battery container defines at least one air inlet, and a first gap is formed between the atomizer electrode and the battery assembly along an axial direction;

wherein the air inlet communicates with the first gap, and the air inlet, the first gap, the first through hole, the second through hole and the channel form an air flow loop;

wherein, the atomizer seat is a hollow cylinder; an end of the atomizer seat which is opposite to the glass fiber tube is connected to the atomizer electrode, and the other end of the atomizer seat which is opposite to the atomizer electrode engages in the glass fiber tube and connects to the heating assembly to realize an electrical connection between the heating assembly and the atomizer electrode;

wherein the electronic cigarette further includes a supporting member of a hollow cylindrical shape;

wherein the supporting member includes a fixing portion and a sleeve portion being perpendicular to the fixing portion; and wherein the fixing portion is configured to connect the atomizer seat with the atomizer electrode, and the sleeve portion is received in the second through hole.

2. The electronic cigarette of claim 1, wherein a second gap is formed between the battery container and the battery assembly;

wherein the battery container is provided with five air inlets, and the air inlets are separated from each other and are located in an axial direction of the battery container equidistantly; some of the air inlets are located in a part of the battery container corresponding to the first gap; the others of the air inlets are located in a part of the battery container corresponding to the second gap;

wherein a width of the first gap is ranged from 0.5 to 10 mm, a width of the second gap is ranged from 0.05 to 7 mm; wherein a cross sectional area of the air inlet is ranged from 0.4 to 3 $mm^2$;

wherein the electronic cigarette further includes a seal ring, the seal ring is mounted at a side of the atomizer electrode away from the atomizer seat, and is configured to seal the battery container; the seal ring is provided with an opening, wherein the opening of the seal ring is communicated with the first through hole;

wherein the electronic cigarette further includes a threaded sleeve which is configured to make the atomizer electrode be fixed; the threaded sleeve is provided with an extension extending toward the atomizer electrode;

wherein the extension engages in an insulating ring, and is connected with the atomizer electrode; the threaded sleeve is connected with the atomizer electrode by the insulating ring to insulate heat and seal the electronic cigarette; and wherein the first through hole, the second through hole and the channel are all coaxial; the battery container is integral with the outer sleeve.

3. The electronic cigarette of claim 1, wherein a shape of the air inlet is any one of round, polygon, waist form and oval.

* * * * *